US006220598B1

(12) United States Patent
Kweitko et al.

(10) Patent No.: US 6,220,598 B1
(45) Date of Patent: Apr. 24, 2001

(54) GAMING TABLE PROTECTIVE SKIRT

(76) Inventors: Ira Kweitko; Wayne Bossung, both of 1302 Autumn Wind Way, Henderson, NV (US) 89012

( * ) Notice: Subject to any disclaimer, the term of this patent is extended or adjusted under 35 U.S.C. 154(b) by 0 days.

(21) Appl. No.: 09/480,308

(22) Filed: Jan. 10, 2000

(51) Int. Cl.[7] ..... A63F 9/00
(52) U.S. Cl. ..... 273/309; 273/287
(58) Field of Search ..... 273/148 R, 309, 273/287

(56) References Cited

U.S. PATENT DOCUMENTS 3,785,419 * 1/1974 Sherlock .
4,158,905 * 6/1979 O'Leary .
4,170,181 * 10/1979 Glasgow .
5,069,554 * 12/1991 Bonnett .
5,084,321 * 1/1992 Sui .
5,715,553 * 2/1998 Baron .
5,908,681 * 6/1999 Foster .

* cited by examiner

*Primary Examiner*—Benjamin H. Layno
*Assistant Examiner*—Vishu Mendiratta
(74) *Attorney, Agent, or Firm*—Quirk & Tratos

(57) ABSTRACT

A protective skirt is disposed on the surface of a gaming table of the type having a player area and a dealer area. The gaming table additionally includes a rail covering the margin of the gaming table proximate the player area. The skirt includes an inner edge, which may be optionally tapered, and an outer edge disposed proximate the rail such that the skirt extends onto the gaming table surface to overlay at least a portion of the player area of the gaming table. Optionally, the outer edge has a shape to substantially conform to the shape of the gaming table. Thus, for a gaming table that is arcuate, the outer edge is substantially arcuate. In an optional embodiment, the skirt may be fixed by securing the outer edge between the rail and the gaming table.

7 Claims, 2 Drawing Sheets

GAMING TABLE PROTECTIVE SKIRT

FIELD OF THE INVENTION

The present invention relates to gaming table coverings. Specifically, the present invention is a protective skirt which covers at least a portion of the playing surface of a gaming table.

BACKGROUND OF THE INVENTION

Gaming tables known in the art typically have flat, solid surfaces covered by a fabric such as felt. However, it is known in the art that the fabric covering the playing surface of gaming tables is subject to wear and damage requiring frequent replacement of the fabric covering. Aside from the normal wear of cards rubbing on the surface and players resting arms, hands, elbows, and the like on the surface, the playing surface may be damaged by condensation from drinks, spills, cigarette and cigar burns, and the like to such an extent that replacement of the playing surface fabric is required. The frequent replacement of such playing surface fabric adds to the costs, in both money and labor, associated with operating a casino.

Often a player will be supplied with a napkin, coaster, or other means of catching condensation from a drink container. However, such devices do not necessarily prevent condensation from reaching the playing surface fabric. For example, if a napkin becomes saturated, the excess condensation will be absorbed by the playing surface fabric. Moreover, the mere rubbing of the napkin, coaster, ash tray, or the like on the playing surface fabric will cause wear and, eventually, necessitate replacement.

Thus, it can be seen that there is a need in the art for a device which overlays at least a portion of the playing surface to prevent wear of the playing surface fabric.

SUMMARY OF THE INVENTION

The present invention is used in conjunction with a gaming table of the type including a player area and a dealer area, said gaming table including a rail covering the margin of the gaming table at the player area. The present invention is a skirt having an outer edge and an inner edge. The outer edge of the skirt is disposed proximate the rail so that the skirt extends to overlay at least a portion of the player area of the gaming table surface. The inner edge is optionally tapered to facilitate the sliding of playing cards across the inner edge.

In an optional embodiment, the skirt is secured from movement by securing the outer edge of the skirt between the rail and the gaming table. In a further optional embodiment, the skirt has a shape that conforms to the gaming table at the player area. That is, the skirt is formed or shaped such that the shape of the skirt corresponds to the shape of the gaming table at the player area. For example, in one optional embodiment specifically designed for use with gaming tables having an arcuate shape at the player area, the skirt has a substantially arcuate shape.

It is an object of the present invention to provide an apparatus to overlay at least a portion of the playing surface of a gaming table to protect the gaming table surface from wear and damage.

BRIEF DESCRIPTIONS OF THE DRAWINGS

DESCRIPTION

Figure 1:
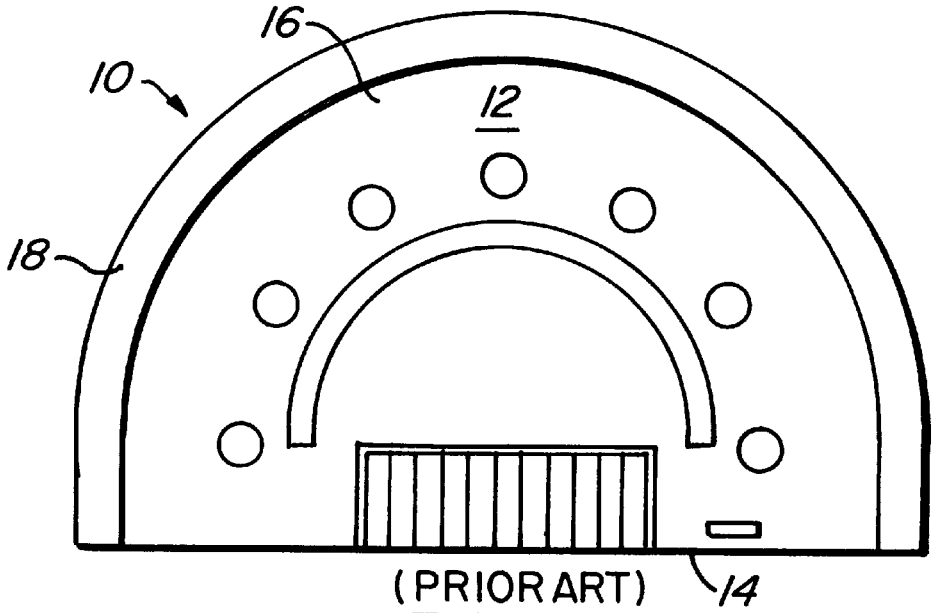
(PRIOR ART) FIG.—1
FIG. 1 is a top view of a gaming table known in the art.

Reference is now made to the figures wherein like parts are referred to by like numerals throughout. Referring to FIG. 1, the present invention is used with a gaming table 10 known in the art. The gaming table 10 has a gaming table surface 12 upon which the gambling game is played. The gaming table surface 12 is typically a fabric, such as felt, covering a flat, solid surface. The gaming table 10 includes a dealer area 14 and a player area 16. A rail 18 covers the margin of the gaming table 10 at the player area 16.

Figure 2:
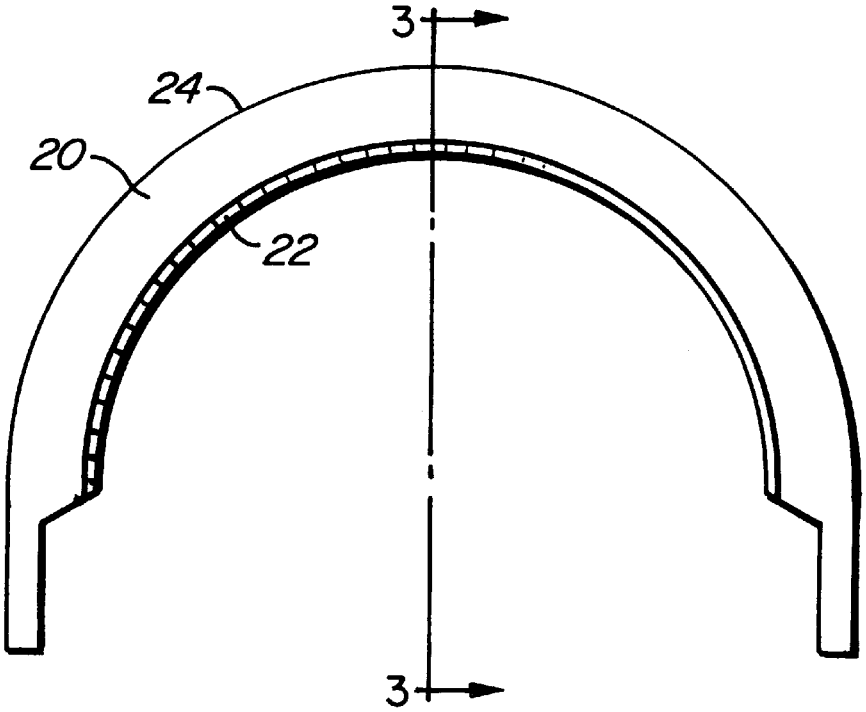
FIG. 2 is a top view of a gaming table skirt according to an embodiment of the present invention.
Figure 3:
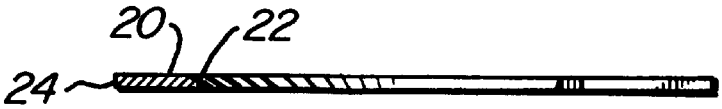
FIG. 3 is a sectional side view of the embodiment of FIG. 2 taken along section line A—A.

With reference to FIGS. 2–3, the present invention is a skirt 20 having an inner edge 22 and an outer edge 24. The skirt 20 is optionally formed from a polymer that is impervious to liquids and resistant to burning. In one optional embodiment, the polymer is clear so that the skirt 20 will not unduly distract players or detract from the look of the gaming table 10. The skirt 20 is optionally thin and substantially flat. The outer edge 24 of the skirt 20 is disposed proximate the rail 18 so that the skirt 20 extends onto the gaming table surface 12 at the player area 16. Thus, the skirt 20 overlays at least a portion of the gaming table surface 12 in front of the players. That is, the skirt 20 may cover the entire gaming table 10 or, in the optional embodiment of FIGS. 4–5, the skirt 20 may cover only a portion of the gaming table 10. The portion of the gaming table surface 12 covered by the skirt 20 is protected from damage and wear caused by player's resting their arms, hands, and elbows on the gaming table surface 12 as well as placing drink containers, ash trays, burning tobacco products, and the like on the gaming table surface 12.

Figure 4:
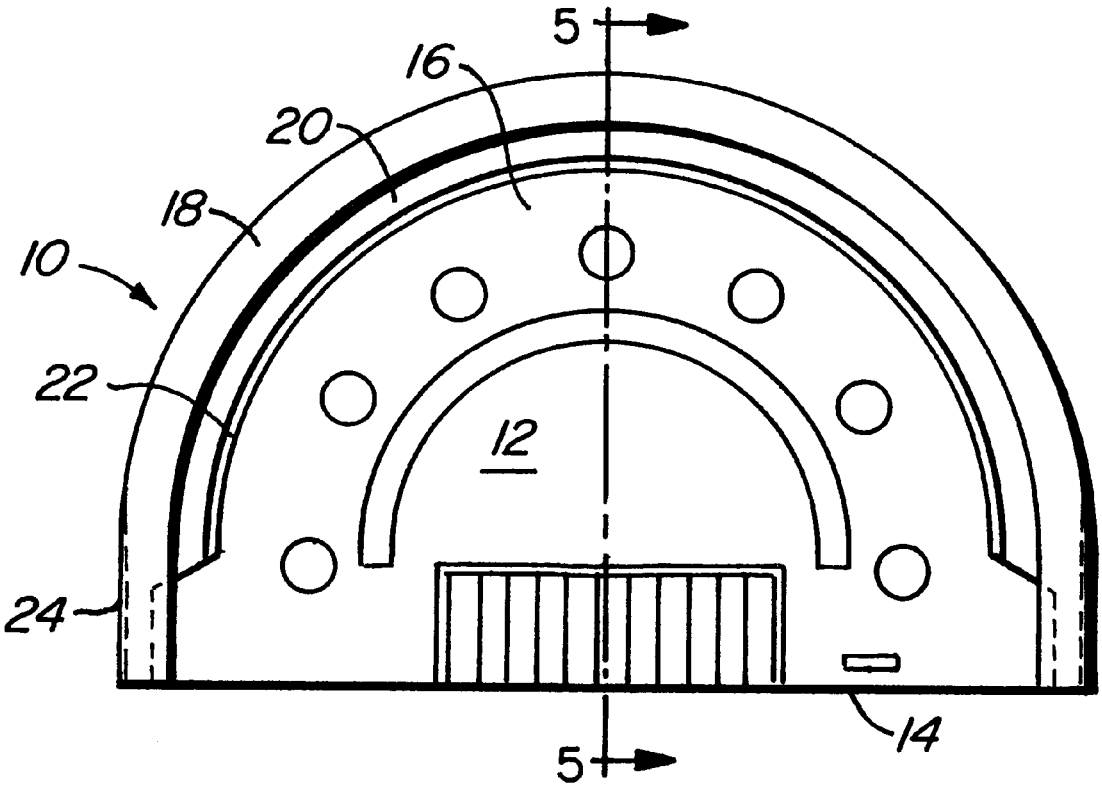
FIG. 4 is a top view of the gaming table skirt according to the embodiment of FIG. 2 overlaying the gaming table of FIG. 1.
Figure 5:
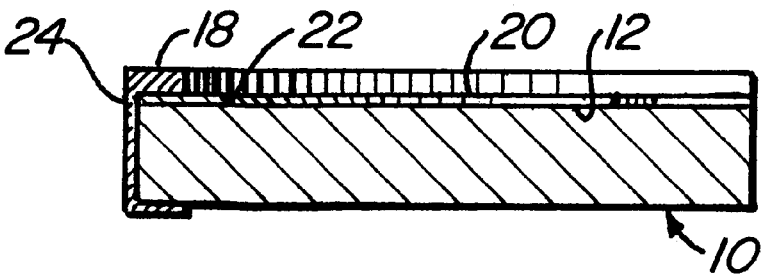
FIG. 5 is a sectional side view of the gaming table and gaming table skirt of FIG. 4 taken along section line B—B.

As shown in FIGS. 4–5, the skirt 20 may optionally be held in place by securing the outer edge 24 between the rail 18 and the gaming table 10. In other words, the skirt 20 is prevented from moving by sandwiching the outer edge 24 between the rail 18 and the gaming table 10. Additionally, the ends of the skirt 20 may aid in securing the skirt 20 from moving by abutting a stop or the like at the dealer area 14.

It is contemplated that the present invention could be used for any gaming table 10 without regard to the shape of the gaming table 10. Thus, the table could be used with a rectangular table, such as a craps table, an arcuate table, such as a blackjack table, or any other shaped table. Optionally, the outer edge 24 of the skirt 20 is shaped to substantially conform to the shape of the gaming table 10 at the player area 16. Thus, for a rectangular table, the outer edge 24 would be substantially a straight line. Likewise, for an arcuate gaming table 10, as shown in FIGS. 1–5, the outer edge 24 would be substantially arcuate to conform to the shape of the gaming table 10.

While not necessary, the inner edge 22 in the embodiment of FIGS. 1–5 is substantially parallel to the outer edge 24. In an optional embodiment, the inner edge 22 of the skirt 20 is also tapered to allow cards to slide easily over the inner edge 22 as they are dealt.

The skirt 20 may be built into newly constructed gaming tables 10 or, alternatively, be retrofitted onto existing gaming tables 10. In retrofitting an existing gaming table 10 with the skirt 20, the skirt 20 is positioned on the gaming table 10 to overlay at least a portion of the player area 16 of the gaming table surface 12 and secured from movement. In an optional embodiment, the skirt 20 is secured from movement by removing the rail 18 by unfastening the fasteners securing the rail 18 to the gaming table 10. The skirt 20 is positioned to rest under the rail 18 when reattached. The rail 18 is positioned in its original position with the skirt 20 disposed between the rail 18 and the gaming table surface 12. The rail 1 8 is reattached to the gaming table 10 to thereby secure the skirt 20 from movement.

In use, the gaming table is used in a manner known in the art. That is, the skirt 20 does not interfere with the normal use of the gaming table. However, with the skirt 20 in place, players may rest their arms, elbows, and hands as well as drink containers, ash trays, and the like on the skirt 20 without causing wear to the gaming table surface 12, thereby extending the life of the fabric thereon. Likewise, spills, ashes from burning tobacco products, and the like contacting the skirt 20 will be prevented from damaging the gaming table surface 12 underlying the skirt 20.

While certain embodiments of the present invention have been shown and described it is to be understood that the present invention is subject to many modifications and changes without departing from the spirit and scope of the claims presented herein.

What is claimed is:

1. An apparatus for protecting the surface of a gaming table of the type including a player area and a dealer area, said gaming table being defined by an arcuate margin and including a rail covering said margin of said gaming table at the player area, comprising:

a game table having an arcuate margin and a rail covering said margin;

a skirt having an outer edge generally conformed to said arcuate margin secured subjacent said rail and an inner edge, generally parallel to said outer edge said skirt extending from said rail onto the gaming table surface to overlay at least a portion of said player area of the gaming table and said inner edge being faired and tapered to increase in the thickness towards said rail.

2. The apparatus of claim 1 wherein:

said skirt is reduced in plan form proximate said dealer area.

3. An apparatus for protecting the surface of a gaming table of the type including a player area and a dealer area, said gaming table being defined by an arcuate margin and including a rail covering said margin of said gaming table at the player area, comprising:

a game table having an arcuate margin and a rail covering said margin;

a planar skirt of a polymeric material structure having an outer edge generally conformed to said arcuate margin secured subjacent said rail and said gaming table surface and an inner edge said skirt extending from the rail onto the gaming table surface in reducing thickness to overlay at least a portion of said player area of said gaming table.

4. The apparatus of claim 3 wherein said outer edge has a shape to substantially conform to said gaming table at said player area and is reduced in plan form proximate said dealer area.

5. An apparatus for protecting the surface of a gaming table of the type including a player area defined by an exterior margin and a dealer area, said gaming table including a rail covering said margin of the gaming table at said margin of the gaming table at said player area, comprising:

a game table having an arcuate margin and a rail covering said margin;

a planar skirt having an outer edge with a shape substantially conforming to said gaming table margin at the player area secured between said rail and said gaming table surface and a tapered inner edge, said skirt extending from said rail onto the gaming table surface to overlay at least a portion of said player area of said gaming table in a reducing thickness taper.

6. In a gaming table characterized by a playing surface comprising a dealer's portion and a player's portion, said player's portion including a generally arcuate peripheral edge and a corresponding arcuate edge rail covering said edge, the improvement comprising:

a game table having an arcuate margin and a rail covering said margin;

a generally arcuate planar strip of a polymeric material structure defined by an outer edge conformed to overlie said peripheral edge subjacent said rail and an inner edge spaced from said outer edge to overlie a point of said player's portion of said surface adjacent said rail, said strip being faired at a reducing thickness taper towards said inner edge.

7. A gaming surface protector according to claim 6 wherein:

said strip is formed of a translucent material structure.

* * * * *